United States Patent [19]

Holtzclaw, Jr. et al.

[11] Patent Number: 4,858,800

[45] Date of Patent: Aug. 22, 1989

[54] HOLSTER WITH ADJUSTABLE RETAINING STRAP

[75] Inventors: James O. Holtzclaw, Jr., Broomfield; Marvin A. Novotny, Denver, both of Colo.

[73] Assignee: The Hunter Company Inc., Westminster, Colo.

[21] Appl. No.: 169,155

[22] Filed: Mar. 8, 1988

Related U.S. Application Data

[63] Continuation of Ser. No. 948,105, Dec. 31, 1986, abandoned.

[51] Int. Cl.[4] ..... F41C 33/02

[52] U.S. Cl. ..... 224/243; 224/193; 224/911; 224/912; 224/253; 24/200

[58] Field of Search ..... 224/911, 912, 191, 192, 224/197, 198, 238, 241, 253, 243; 24/197, 200, 623, 590

[56] References Cited

U.S. PATENT DOCUMENTS

| | | | |
|---|---|---|---|
| 1,541,701 | 6/1925 | Gaunt | 24/200 |
| 1,656,751 | 1/1928 | Myers | 24/200 |
| 2,466,741 | 4/1949 | Roehrl | 24/580 |
| 2,482,846 | 9/1949 | Fox | 24/580 |
| 3,011,687 | 12/1961 | Boyt | 224/911 X |
| 3,064,271 | 11/1962 | Kuber | 24/200 |
| 3,484,907 | 12/1969 | Elsenheimer | 24/580 X |
| 3,565,303 | 2/1971 | Rippen | 224/911 X |
| 3,986,658 | 10/1976 | Arneson et al. | 229/40 |
| 4,000,544 | 1/1977 | Fildan | 24/590 |
| 4,270,680 | 6/1981 | Bianchi | 224/193 |
| 4,273,276 | 6/1981 | Perkins | 224/243 |
| 4,312,466 | 1/1982 | Clark | 224/243 |
| 4,391,223 | 7/1983 | Holland et al. | 229/16 A |
| 4,502,192 | 7/1985 | Hess | 24/590 |
| 4,696,419 | 9/1987 | Holtzclaw, Jr. et al. | 224/243 |
| 4,750,655 | 6/1988 | Barry | 224/243 |

FOREIGN PATENT DOCUMENTS

| | | | |
|---|---|---|---|
| 695930 | 9/1940 | Fed. Rep. of Germany | 224/911 |
| 1166936 | 11/1958 | France | 24/580 |
| 1407141 | 6/1965 | France | 24/200 |
| 128476 | 6/1919 | United Kingdom | 224/911 |
| 709133 | 5/1954 | United Kingdom | 24/200 |

*Primary Examiner*—Ernest G. Cusick

*Attorney, Agent, or Firm*—Fitch, Even, Tabin & Flannery

[57] ABSTRACT

A holster includes an adjustable safety strap which is adjustably attached to a belt-receiving portion of the holster. In one embodiment of the invention, the holster is made from two pieces of material which are sewn together so as to require a single snap fastener. Thus, with three parts, two pieces of material and a snap fastener, a completed holster is provided. One piece of material includes front and back walls of the holster and is folded over and sewn together to form a handgun-receiving pocket. A loop-forming portion for receiving a belt or the like is formed from an extension of the back wall and has a lower free end joined to the back wall with stitching. The second piece of material is a retaining strap having a first end joined to a front wall of the holster and a second end received in a series of elongated, parallel slots formed in the loop-forming portion. The second end of the retaining strap can be inserted in different slots to provide an adjustment thereof.

2 Claims, 2 Drawing Sheets

HOLSTER WITH ADJUSTABLE RETAINING STRAP

This application is a continuation of application Ser. No. 984,105 filed Dec. 31, 1986, now abandoned.

1. Field of the Invention

BACKGROUND OF THE INVENTION

The invention relates generally to handgun holsters, and in particular to handgun holsters having adjustable restraining straps.

2. Brief Description of Prior Art

It is well known to employ a safety strap to retain a handgun in a holster. It is generally desirable that the safety strap be relatively easily releasable to facilitate withdrawal of the handgun, and accordingly a safety strap is typically attached at one end to a front wall of the holster by a releasable fastener such as a snap arrangement. It is also desirable that a safety strap be adjustable to permit the holster to accommodate guns of different sizes.

Frequently, adjustable straps for securing the handgun in the holster are attached at one end to a portion of the holster adjacent the belt loop. The other end is connected to the front wall of the holster for easy release.

Holsters typically are releasably supported by a belt, and include a belt loop for this purpose, through which a belt is threaded. The belt loop has a first end attached to a back wall of the holster immediately adjacent the wearer's leg, and a second, lower free end which is either secured to the back wall, or is attached to a body strap encircling or girdling the body of the holster at its lower end. Typically, the body strap has a midportion attached to the belt loop at a back wall of the holster, and two ends which are brought to the front wall of the holster where they are joined together by a snap fastener or the like.

Previous arrangements of holsters having releasable straps will now be described. As will be seen, the construction of these arrangements is somewhat complicated, requiring many parts for their assembly, and requiring several steps for performing that assembly.

U.S. Pat. No. 4,270,680 provides an upstanding vertically-oriented tab secured to the belt loop of a holster with opposed L-shaped spring arms. The tab is formed of a leather body which is riveted and sewn to contain the spring legs. The gun-retaining strap is snapped at one end to the upstanding tab, and is snapped at its other end to the front wall of the holster, in the usual manner.

U.S. Pat. No. 3,011,687 provides a holster with a belt loop having a free end secured with a girdle-like body strap which encircles the body of the holster and is snapped in position at a point overlying the holster front wall. The handgun-retaining strap has an inner end riveted to the belt loop and has a free end with the customary releasable snap fastener. The handgun-retaining strap is not adjustable.

U.S. Pat. No. 3,565,303 discloses a belt loop whose free end is secured to the holster body with a girdle-like body strap which encircles the holster body. An adjustable handgun-retaining strap is formed of two strap members which are riveted together. A first strap member has a free end releasably secured to a front wall of the holster with a customary snap fastener. The other strap member is secured to the belt loop with a screw fastener after a belt is threaded through the belt loop, between a hinged portion thereof and the second strap member. Not only is the belt-threading operation complicated, the screw-type securement is somewhat tedious to perform and leaves the tip of the screw shaft exposed for possible penetration into the back wall of the holster. Further, several steps are required to form not only the handgun-retaining strap but also the remainder of the holster construction.

U.S. Pat. No. 4,312,466 illustrates one type of holster employing a fastener arrangement of two fabric-like hook and loop materials that adhere to each other when pressed into contact. One fastener material is sewn to the inside surface of the belt loop, its free end being fastened to a front holster wall with a snap fastener, in the customary manner. The snap fasteners for securing the free end of the belt loop are applied to a separate thickness of material which, in turn, is sewn to a holster back wall.

Other arrangements for providing fastener material to a belt loop are known. For example, one type of fastener material has been provided on the back wall of the holster. In order to provide an adjustable, handgun-retaining strap, a girdle-like body strap for the free end of the belt loop has been provided. This arrangement provides a significant improvement over U.S. Pat. No. 4,312,466 because, due to the orientation of the handgun-retaining strap relative to the rear holster wall, tension forces applied to the fastener material are almost totally in shear, and are therefore better restrained by the fastener material.

Any of the arrangements described above require assembly of several different components in multiple steps or stages of manufacture. Several of the above arrangements, such as those employing a two-part fastener material, introduce extra protruding members within the belt loop which obstruct the threading of a belt therethrough.

Several of the arrangements described above require a girdle-like body strap comprised of either one or two strap members which must be secured to the free end of the belt loop, adding extra layers of thickness between the back wall of the holster and the wearer's leg. The holster is susceptible to rotation about its longitudinal axis because of rockable contact of the belt loop with the outer portion of the wearer's leg, and since the safety straps protruding into the interior of the belt loop, particularly those straps attached to a holster back wall also cause a rocking against the wearer's belt. This rocking is particularly pronounced when a two-part (e.g., hook and loop) fastener material is employed, since three relatively narrow strips, each of substantial thickness, are built one on top of the other within the belt loop. In some instances, this rocking is objectionable, and in general, wearing comfort is improved if the major portion of the holster back wall is in direct contact with the wearer's leg throughout most of its axial length.

It is generally undesirable to have fasteners protruding into the interior of the holster, so as to avoid engagement with the handgun. In general, the mounting of snap fasteners, particularly to the holster walls, requires multiple or additional thicknesses of material. In addition to adding to the expense of manufacture, this additional material may detract from the appearance of the holster, and may interfere with the comfort of the wearer.

SUMMARY OF THE INVENTION

It is an object of the present invention to provide an adjustable strap where the interior walls of the belt loop are relatively smooth and uninterrupted so as to facilitate the threading of a belt therethrough.

It is an additional object of th present invention to invention to provide a holster having a relatively unobstructed back wall which presents a maximally large surface for contact with the wearer's leg, thereby contributing significantly to the comfort of the wearer.

It is a further object of the invention to provide an adjustable handgun-retaining strap compatible with a holster meeting the above-described objectives.

Further, from the standpoint of product appearance as well as the commercially important aspects of product assembly and manufacture costs, it is a specific object of the present invention to provide a holster having an adjustable handgun-retaining strap comprised of a minimum number of inexpensive parts readily formed with a minimum number of mechanical fasteners, such as snap fasteners and the like.

These and other objects of the present invention, which will become apparent from studying the attached description and drawings, are provided in a handgun holster comprised of a pocket member having back and front walls defining a handgun-retaining pocket having a handgun-receiving opening at its upper end. A loop-forming portion extends downwardly from an upper end of the back wall to a lower end, the lower end being attached to a lower portion of the back wall so as to form a belt-receiving loop with the back wall. The loop-forming portion has a plurality of wall means, each defining a strap-receiving slot associated with a strap adjusting position. A strap is provided to retain the handgun in the pocket, the strap having a first end selectively receivable in the slots and further having a second, free end. Means are provided for releasably securing the free end of the retaining strap to the front wall. Means, carried by the first end of the strap, locate the strap at an adjustment position, and are adapted to engage a selected wall means when inserted through the slot defined by the wall means.

BRIEF DESCRIPTION OF THE DRAWINGS

In the drawings, wherein like elements are referenced alike.

DETAILED DESCRIPTION OF THE PREFERRED EMBODIMENT

Figure 1:
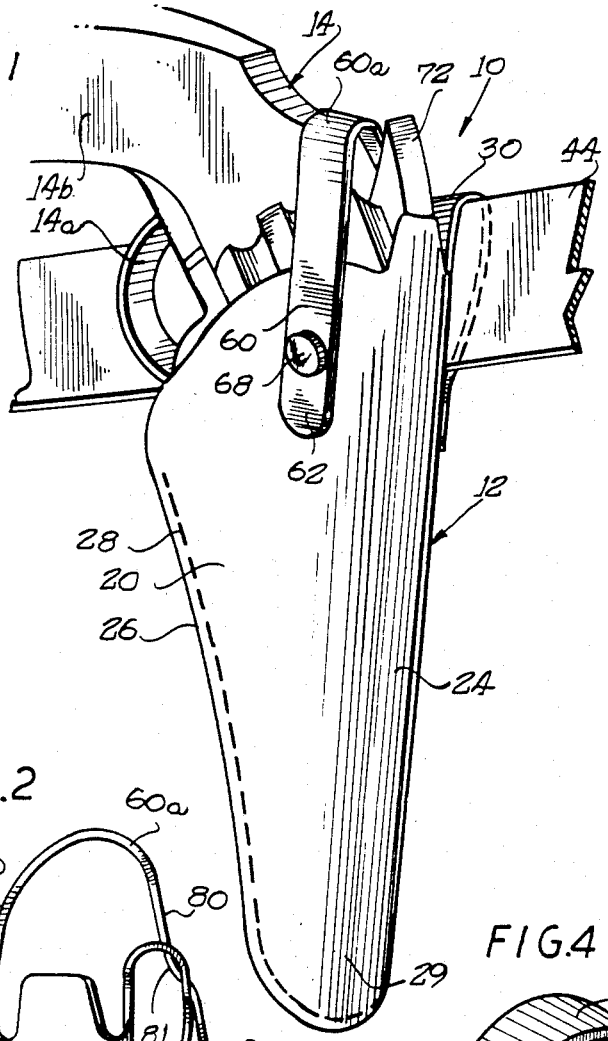
FIG. 1 is a perspective view of one embodiment of a holster illustrating the present invention.

Referring now to the drawings, and initially to FIGS. 1–4, a holster 10 illustrating features of the present invention includes a pocket member 12 for receiving a handgun 14. The pocket member 12 includes a front wall 20, visible in FIG. 1, and a back wall 22 visible in FIG. 3. One feature of the present invention is that holster 10 can be economically fabricated from a minimum number of inexpensive parts. In each of the several illustrated embodiments herein, holster 10, as will be seen, is fabricated from three parts, including the snap fastener for the handgun-retaining safety strap. Accordingly, pocket member 12 is preferably formed from a single, integral leather blank wherein front and back walls 20, 22 are joined to an intermediate bight portion or ventral edge 24 formed by folding the leather blank so as to bring front and rear walls 20, 22 in overlying relationship. After folding, the dorsal edge 26 of the pocket member is secured by stitching 28 which joins the dorsal edges of the front and back walls together. Preferably, stitching 28 continues to the bottom end 29 of the pocket member to enclose the lower end of the handgun 14. Instead of stitching 28, the edge of front and rear walls 20, 22 can be joined by adhesive, rivets, staples, or the like fastening materials. Further, the bottom end 29 of the bottom member 12 need not be enclosed.

A flap member 30, which is preferably included in the integral leather blank, extends from an upper end 32 of back wall 22 in a downward direction, terminating in a free end 36 which is joined to a lower portion 40 of back wall 22. As shown most clearly in FIG. 3, the free end 36 of flap 30 is secured to back wall 22 by stitching 42. However, other fastening arrangements can be employed. Flap 30 forms a belt-receiving loop 42 with back wall 22. As illustrated in FIG. 1, a belt 44 is threaded through loop 42 to provide convenient support for holster 10 about the waist of a wearer.

A safety strap 60, which is used to retain handgun 14 in pocket member 12, comprises a second component of holster 10. Safety strap 60 has a free end 62 visible in FIG. 1, which is releasably secured to front wall 20 of the pocket member with a snap fastener 68, the third and final component of holster 10. As shown in the first illustrated embodiment of FIG. 1, the safety strap 60 engages handgun 14 immediately behind its hammer lever 72. Safety strap 60 restrains handgun 14 against any vertically upward forces that would tend to extract the handgun from pocket member 12. As such, safety strap 60 is placed under tension. Accordingly, the second end 80 of safety strap 60, must be attached to the holster to provide adequate securement against any tension loads.

Frequently, it is desired to store handguns of different sizes and shapes in holster 10. Different handguns, due to their different configurations, require safety straps of different lengths to securely retain the handguns with a snug fit. For example, if the handgun 14 illustrated in FIG. 1 is replaced with a larger handgun, and safety strap 60 is not adjustable, the increased size of the handgun would prohibit proper alignment between free end 62 of the safety strap and the snap fastener component attached to front wall 20. In other words, safety strap 60 would not be long enough in this instance to provide a proper releasable attachment to the front wall of the holster. Conversely, if a smaller handgun were placed in the holster of FIG. 1, the safety strap 60, if not adjustable, would not engage the handgun at its upper bight portion **60*a*. If the gap between the bight portion 60*a* and the handgun is great enough, the safety strap 60 may be inadvertently shifted over hammer lever 72 so as to no longer retain the handgun in the holster. Accordingly, it is desirable that strap 60** be made adjustable in length to accommodate handguns of different dimensions.

Figure 3:
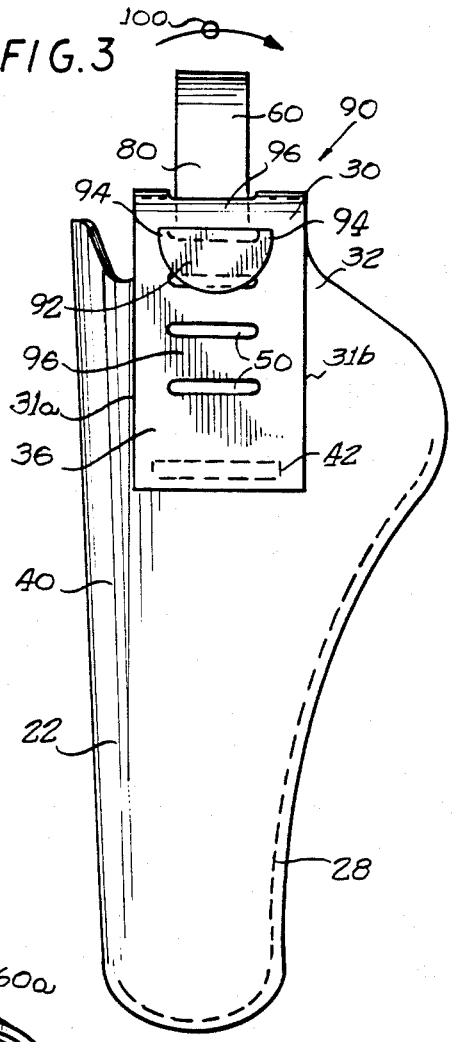
FIG. 3 is a rear elevational view of the holster of FIGS. 1 and 2.

Referring now especially to FIG. 3, an arrangement 90 for adjusting the length of safety strap 60 includes a generally parallel spaced array of slots 50 formed in interior portions of flap 30. Preferably, slots 50 are formed by cutting flap 30 while the leather blank is still in its unformed state. As illustrated in FIG. 3, slots 50 are arranged in a generally vertical array, each slot 50 extending in a direction generally normal to a longitudinal axis of the elongated flap 30.

To ensure adequate tear resistance, the walls of each slot 50 are spaced minimum distances from each other, and from the lateral edges 31*a*, 31*b* of the flap 30.

The second end 80 of safety strap includes a "D-shaped" enlarged end portion 92 having outwardly extending edges or ears 94. As can be seen in FIG. 3, ears 94 have generally transverse straight-line edges 94*a*. Safety strap 60 is preferably made of relatively soft and pliable material so that the ears 94 of its enlarged end can be folded or otherwise deflected to allow insertion through one or more slots 50 as illustrated most clearly in FIGS. 3 and 4. After insertion through the slots, tension forces applied to safety strap 60 will draw the transverse straight-line edges 94*a* of ears 94 into contact with the wall portions forming those slots to prevent the safety strap from being withdrawn therethrough.

Figure 2:
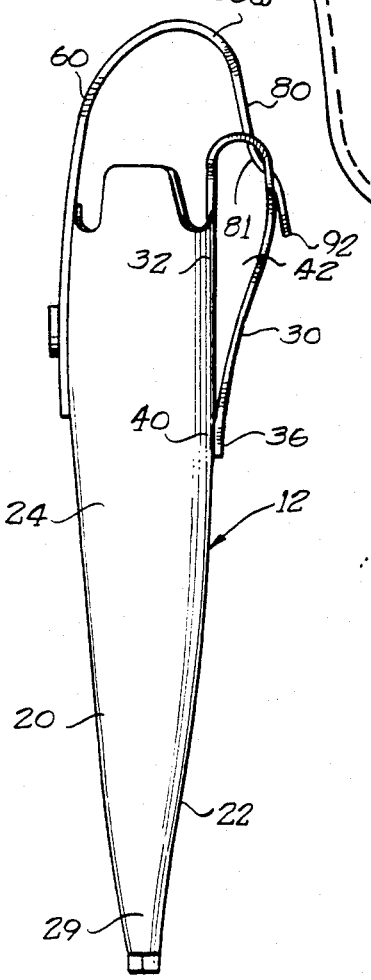
FIG. 2 is a side elevational view of the holster of FIG. 1.

If desired, enlarged end 92 can be inserted through a single slot 50 so as to reside in belt-receiving loop 42. However, this is not the preferred mode of securement since the enlarged end 92 might obstruct the free passage of the belt 44 as the belt is threaded through the loop 42. To preclude any interfering engagement between enlarged end 92 and the belt 44, and to provide additional retention, the enlarged end 92 of safety strap 60 is preferably threaded through two adjacent slots 50. As shown most clearly in FIGS. 3 and 4, the slots 50, arranged in a spaced-apart array, form cross members 96 between adjacent slots. As enlarged end 92 is threaded through two successive slots 50, the free end 80 of the safety strap is drawn underneath a cross member 96 to provide an even more secure retention of the safety strap in the adjustment means 90, and to prevent the strap from intruding substantial amounts into loop 42. The side view of FIG. 2 is drawn out of scale in this respect, as portion 81 of strap 60 closely follows the contour of flap 30. The amount of protrusion into loop 42 is exaggerated to emphasize the construction of the adjusting arrangement 90. To further enhance this smooth-wall feature of loop 42, cross members 96 can be reduced in width and or made longer, or of reduced thickness.

Figure 4:
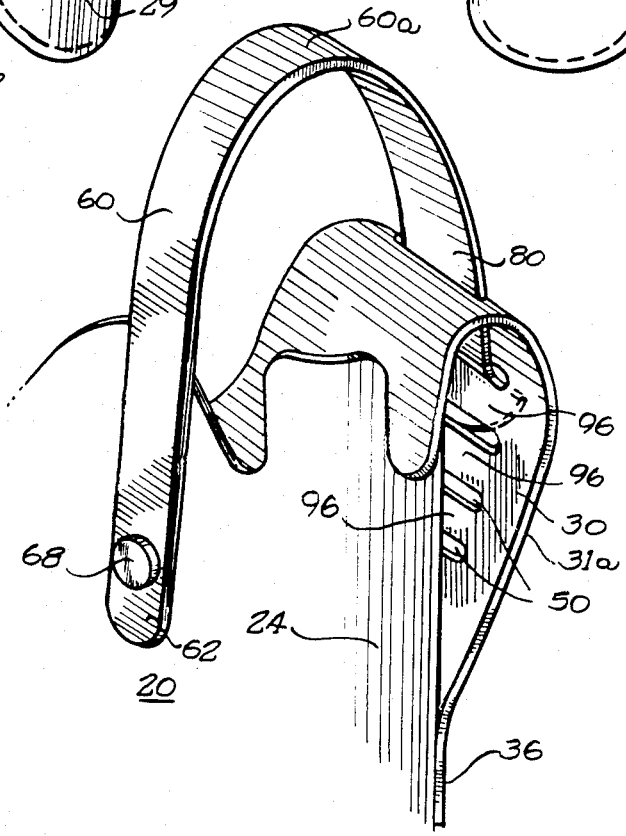
FIG. 4 is a fragmentary perspective view of a portion of the holster of FIG. 1.

As will now be appreciated, the free end of safety strap 60 can be inserted through any one of the series of slots 50, at a variety of different adjustment positions. Thus, if the enlarged portion 92 is threaded through a pair of slots 50 located at the lower end of flap 30, the length of safety strap 60 is, in effect, shortened to accommodate handguns of smaller size. While a simple tension applied to safety strap 60 will not bring an enlarged end out of engagement with flap 30, the ears 94 of that enlarged end can be deflected with intentional manipulation, to free the safety strap from its point of securement. Thereafter, to accommodate handguns of larger size, for example, the enlarged end of the safety strap can be inserted through slots located at upper portions of flap 30, such as is illustrated in FIGS. 3 and 4. This, in effect, increases the effective length of the safety strap 60 to accommodate handguns of larger size.

Although the safety strap 60 is illustrated as being threaded through adjacent successive slots 50, it will be readily appreciated that the safety strap can be threaded through every third or fourth slot, for example, and that the slots need not be adjacent each other. Further, the safety strap can be threaded or laced through several slots 50 so as to engage multiple cross members 96. Other threading arrangements are, of course, possible.

As illustrated in FIG. 1, safety strap 50 engages handgun 14 adjacent its hammer lever 72. Frequently, it is desired to secure handgun 14 in the alternative manner illustrated in FIG. 7 wherein the safety strap is wrapped around the trigger guard 14*a* adjacent the handle 14*b* of the handgun. The adjusting arrangement 90 described above can, without modification, accommodate this second alternative position of the safety strap. The snap fastener 68 at the free end of the safety strap will freely allow a pivoting of the safety strap in the direction of arrow 100 (see FIG. 3) necessary to attain the position shown in FIG. 7. The slots 50, if made wide enough, will allow the second end 80 of the safety strap to be offset at an angular (i.e., clockwise) position from that illustrated in FIG. 3, without kinking, buckling or otherwise bending portions of the safety strap exiting flap 30. However, even if the slots 50 are dimensioned to provide a relatively close fit with the safety strap, strap 60 can be made compliant or flexible enough to allow the strap to attain the position shown in FIG. 7. However, any such buckling adjacent free end 80 which would otherwise result can be eliminated not only by lengthening slots 50 as described above, but also by providing the alternative adjustment arrangements illustrated in FIGS. 5 or 6.

Figure 5:
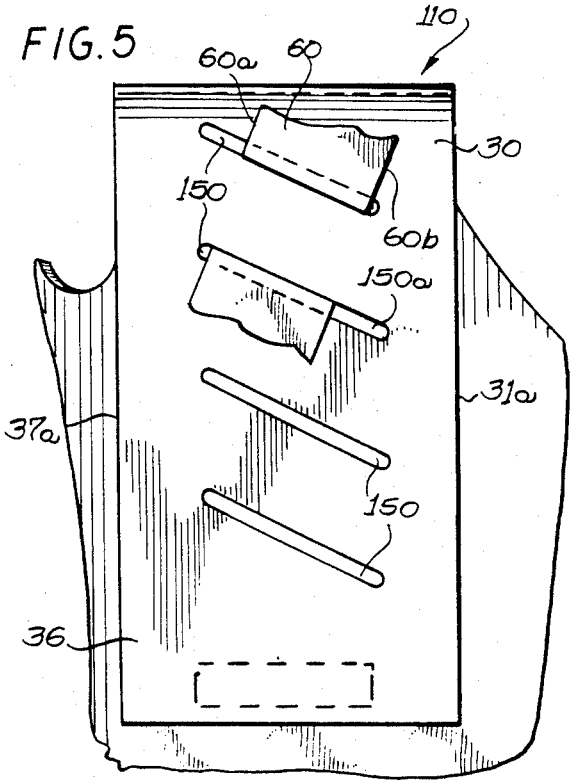
FIGS. 5 and 6 are enlarged fragmentary rear views of alternative holsters illustrating the present invention.

Referring now to FIG. 5, a fragmentary view of the rear portion of the holster (see FIG. 3) illustrates an alternative adjusting arrangement 110. Arrangement 110 is substantially identical to that illustrated in FIG. 3, except that the strap-receiving slots 150 thereafter are inclined at an acute angle from their generally horizontal position illustrated in FIG. 3. Preferably, slots 150 are angled in a clockwise direction by approximately 30°, but may be inclined at any angle between approximately 20° and 60°. The normal to the inclined slots 150 points in a direction more closely corresponding to the orientation of safety strap 60 illustrated in FIG. 7.

Figure 7:
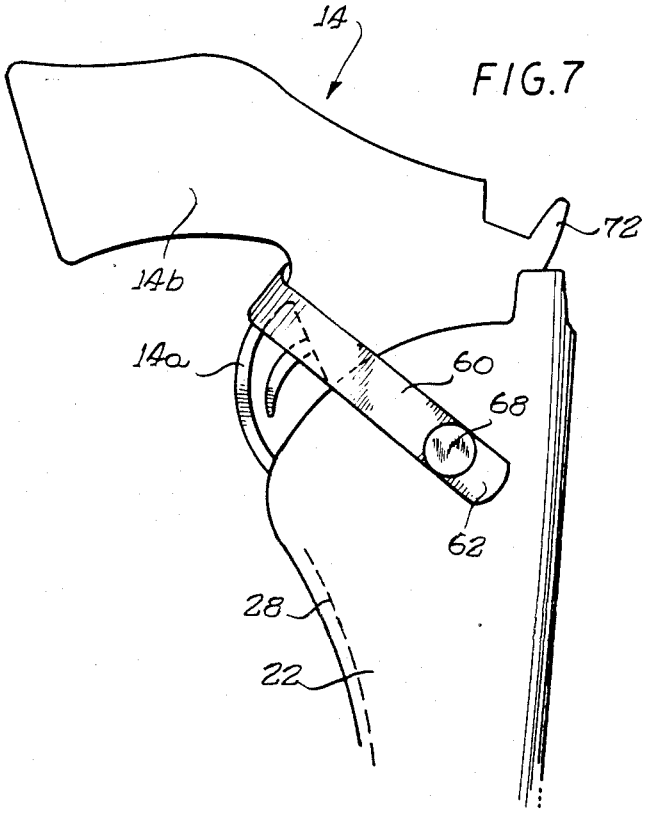
FIG. 7 is a front view of a holster similar to that of FIG. 1, but shown with an alternative positioning of the safety strap.

The spacing and the length of slots 150 is the same as that illustrated in FIG. 3, and accordingly, if a safety strap 60 having the same relative proportions as those illustrated in FIG. 3 can move between the positions of both FIGS. 1 and 7 when located according to FIG. 7, the strap will assume the position illustrated in FIG. 5 wherein lateral edges 60*a*, 60*b* of the safety strap 60 will be positioned adjacent alternate ends of successive slots 150. The free end of safety strap 60 can be provided with the same ear portions 94 illustrated in FIG. 3. In general, it is sufficient that only one ear portion 94 engage the wall of a slot 150. If desired, one ear can be enlarged so as to overlie the unoccupied slot portion 150*a* illustrated in FIG. 5, although such is generally, not necessary.

Figure 6:
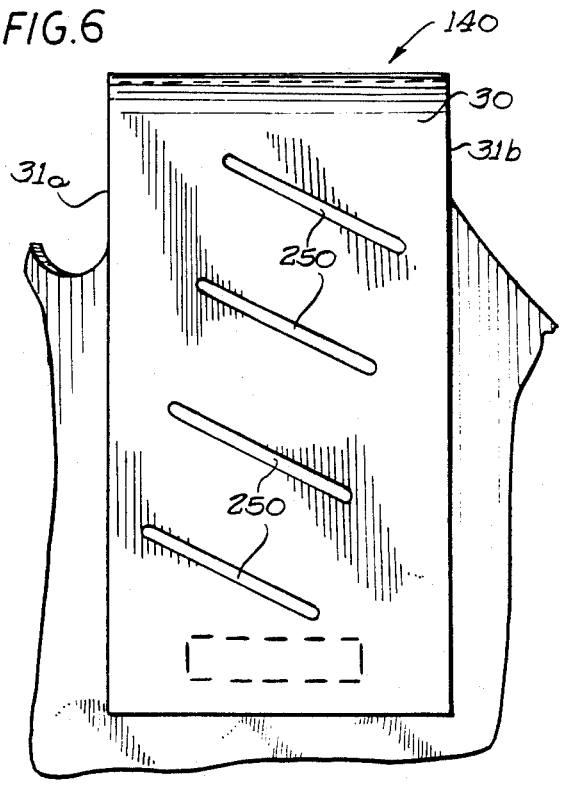

A wearer preferring the configuration of FIG. 7 can be provided with a third adjusting arrangement 140 illustrated in FIG. 6. Arrangement 140 is substantially identical to that of FIG. 5, except that slots 250 are considerably shorter than the slots 150 illustrated in FIG. 5. That is, slots 150 more closely conform to the width of the safety strap 60 employed. The arrangement of FIG. 6 provides additional retention to a safety strap 60, but some buckling of the safety strap may be experienced when the strap is moved to the configuration of FIG. 1. That is, as a safety strap inserted through multiple slots 250 is inclined in a counterclockwise, more nearly vertical, direction, its first end adjacent the flap 30 may tend to buckle. However, this buckling may not be objectionable, and if the safety strap is made sufficiently flexible, the buckling itself will be minimal.

As opposed to the arrangement of FIG. 5, wherein the end points of slots 150 are uniformly spaced uniform distances between flap edges 31*a*, 31*b*, the ends of slots 250 in FIG. 6 are staggered varying amounts with respect to the flap edges. With regard to tear resistance, the most critical dimensions in FIG. 6 are the spacings between the righthand end of the uppermost slot 250 and the lefthand end of the lowermost slot 250. If these minimum distances are made sufficiently great, tearing of the flap 30 from the ends of these extremal slots will not be experienced.

Three different arrangements of strap-receiving slots have been described. With reference to FIG. 3, a series of elongated slots have been provided in flap 30 to receive the retaining strap 60. The slots as illustrated in FIG. 3 are generally coextensive and have longitudinal axes disposed generally at right angles to a longitudinal axis of the flap 30. A second arrangement is illustrated in FIG. 5, wherein a series of elongated slots are provided, with longitudinal axes disposed at an acute angle to the longitudinal axis of the flap 30. The longitudinal slots in FIG. 5 are each generally centered about the longitudinal axis of the flap. With reference to FIG. 6, a third arrangement is illustrated wherein a series of generally coextensive slots are arranged so as to be centered about a line forming an acute angle with the longitudinal axis of the flap 30.

What is claimed is:

1. A handgun holster for receiving a handgun comprising:

a pocket member including front and back walls each having upper and lower ends, the front and back walls joined together to define a handgun-retaining pocket with an upper end defining a handgun-receiving opening;

an elongated loop-forming portion having a longitudinal axis, and a free end, and extending from the back wall upper end and bent so that the loop-forming portion free end is downwardly extending, said loop-forming portion further having a plurality of slot-forming edges forming a series of generally parallel, spaced apart, elongated strap-receiving slots, each having a longitudinal axis extending at an acute angle to the longitudinal axis of said loop-forming portion;

means for joining the free end of said loop-forming portion to said back wall;

a double-ended elongated retaining strap for retaining a handgun in said pocket, said strap having a cross section dimensioned for insertion through said strap-receiving slots, an enlarged free end with outwardly extending ears for engaging said loop-forming portion adjacent a slot-forming edge thereof to prevent unintentional withdrawal of said free end through said slots and said retaining strap further including a second free end overlying at least a portion of said front wall; and means for releasably securing the second free end of said retaining strap to said front wall.

2. A handgun holster for receiving a handgun comprising:

a pocket member including front and back walls each having upper and lower ends, the front and back walls joined together to define a handgun-retaining pocket with an upper end defining a handgun-receiving opening;

an elongated loop-forming portion having a longitudinal axis and a free end, extending from the back wall upper end and bent so that the loop-forming portion free end is downwardly extending, said loop-forming portion further having a plurality of slot-forming edges forming a series of generally coextensive, parallel, spaced-apart, elongated strap-receiving slots, each centered about and generally perpendicular to a line forming an acute angle with the longitudinal axis of said loop-forming portion;

means for joining the free end of said loop-forming portion to said back wall;

a double-ended elongated retaining strap for retaining a handgun in said pocket, said strap having a cross section dimensioned for insertion through said strap-receiving slots, an enlarged free end with outwardly extending ears for engaging said loop-forming portion adjacent a slot-forming edge thereof to prevent unintentional withdrawal of said free end through said slots and said retaining strap further including a second free end overlying at least a portion of said front wall; and means for releasably securing the second free end of said retaining strap to said front wall.

* * * * *

UNITED STATES PATENT AND TRADEMARK OFFICE

CERTIFICATE OF CORRECTION

PATENT NO. : 4,858,800

DATED : August 22, 1989

INVENTOR(S) : James O. Holtzclaw, Jr.

It is certified that error appears in the above-identified patent and that said Letters Patent is hereby corrected as shown below:

IN THE SPECIFICATION:

Under the heading entitled, "References Cited, U.S. Patent Documents," change the name "Rippen" to --Kippen--.

In column 1, line 6, change the numeral "984,105" to --948,105--.

In column 1, line 9, move the title "BACKGROUND OF THE INVENTION" before subtitle "1. Field of the Invention."

In column 3, lines 7-8, after "invention" delete "to invention".

IN THE CLAIMS:

In column 8, Claim 1, line 1, change "spaced apart" to --spaced-apart--.

Signed and Sealed this

Twenty-eighth Day of August, 1990

*Attest:*

HARRY F. MANBECK, JR.

*Attesting Officer*

*Commissioner of Patents and Trademarks*